US007360377B2

(12) United States Patent
Park et al.

(10) Patent No.: US 7,360,377 B2
(45) Date of Patent: Apr. 22, 2008

(54) REFRIGERATOR

(75) Inventors: Yong Pil Park, Suwon-Si (KR); Sang Min Park, Gwangiu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 321 days.

(21) Appl. No.: 11/221,973

(22) Filed: Sep. 9, 2005

(65) Prior Publication Data

US 2006/0065007 A1 Mar. 30, 2006

(30) Foreign Application Priority Data

Sep. 30, 2004 (KR) ..... 10-2004-0078098
Aug. 22, 2005 (KR) ..... 10-2005-0076773

(51) Int. Cl.
*F25C 5/02* (2006.01)

(52) U.S. Cl. ..... 62/320; 62/344; 241/DIG. 17

(58) Field of Classification Search ..... 62/320, 62/344; 222/271, 413; 241/DIG. 17
See application file for complete search history.

(56) References Cited

U.S. PATENT DOCUMENTS 2,694,256 A * 11/1954 Coon, Sr. et al. ..... 222/271
3,329,223 A * 7/1967 Swanson et al. ..... 177/80
3,799,405 A * 3/1974 Wallace ..... 222/238
3,918,266 A * 11/1975 Gindy et al. ..... 62/137
4,189,063 A * 2/1980 Matthiesen ..... 222/1
4,817,827 A * 4/1989 Kito et al. ..... 222/238
4,942,983 A * 7/1990 Bradbury ..... 222/238
5,277,016 A * 1/1994 Williams et al. ..... 53/459
5,680,771 A * 10/1997 Yoo et al. ..... 62/320
6,050,097 A * 4/2000 Nelson et al. ..... 62/137
2006/0059939 A1* 3/2006 An et al. ..... 62/344
2006/0207270 A1* 9/2006 Voglewede et al. ..... 62/135

FOREIGN PATENT DOCUMENTS

JP 5-118723 5/1993

* cited by examiner

*Primary Examiner*—William E Tapolcai
(74) *Attorney, Agent, or Firm*—Staas & Halsey LLP

(57) ABSTRACT

A refrigerator including a shaved ice dispensing unit positioned within a freezing compartment door and plural ice dispensing units positioned in an ice cube container to selectively dispense ice cubes, crushed ice and shaved ice. First and second ice dispensing units are positioned in parallel in a freezing compartment. The first ice dispensing unit supplies ice cubes to the shaved ice dispensing unit, and the second ice dispensing unit selectively dispenses the ice cubes and crushed ice through an ice cube/crushed ice discharge port positioned in the freezing compartment door. The shaved ice dispensing unit includes a case having a shaved ice outlet formed therethrough, at least one blade positioned to the shaved ice outlet, a rotational barrel rotatably positioned within the case to be rotated by a driving motor and a reduction gear assembly. The rotational barrel includes a spiral wing provided on an inner peripheral surface of the rotational barrel to force the ice cubes to be conveyed to the blade and shaved into the shaved ice.

15 Claims, 5 Drawing Sheets

REFRIGERATOR

CROSS-REFERENCE TO RELATED APPLICATION

This application claims the benefit of Korean Patent Application No. 2004-78098, filed on Sep. 30, 2004 and Korean Patent Application No. 2005-76773, filed on Aug. 22, 2005 in the Korean Intellectual Property Office, the disclosure of which is incorporated herein by reference.

BACKGROUND OF THE INVENTION

1. Field of the Invention

The present invention relates to a refrigerator, and, more particularly, to a refrigerator which includes a shaved ice dispensing unit equipped within a freezing compartment door to dispense shaved ice, and an ice dispensing unit equipped within an ice cube container to dispense ice cubes and crushed ice.

2. Description of the Related Art

Generally, a refrigerator includes a freezing compartment, and a refrigerating compartment, which are partitioned from each other to store various foods at a low temperature in an appropriate state for a long time. The refrigerating compartment includes various refrigerated foods, such as vegetables and fruits, which require storage above freezing, and the freezing compartment includes various frozen foods, such as pork, beef, and fish, which require storage below freezing.

The freezing compartment includes an automatic icemaker to produce ice cubes of a predetermined size or more using cold air circulating within the freezing compartment. The automatic icemaker includes an ice tray to automatically freeze water into the ice cubes, and an ice cube container disposed below the ice tray to contain the ice cubes produced in the ice tray. The automatic icemaker is configured such that, after water is automatically fed into the ice tray and formed into the ice cubes, the ice cubes are automatically conveyed to and contained within the ice cube container, and such that, in the event of a deficiency of the ice cubes within the ice cube container, the above mentioned automatic process of producing the ice cubes is repeated by supplying water into the ice tray.

However, since the conventional refrigerator is not provided with a shaved ice dispensing unit to dispense shaved ice after making the ice cubes produced by the automatic icemaker into the shaved ice, it is very inconvenient for users of the conventional refrigerator to produce the shaved ice, for example, when making iced beverages using the shaved ice.

SUMMARY OF THE INVENTION

Accordingly, it is an aspect of the present invention to provide a refrigerator, which includes a shaved ice dispensing unit equipped within a freezing compartment door to dispense shaved ice, and an ice dispensing unit equipped within an ice cube container to dispense ice cubes and crushed ice.

Additional aspects and/or advantages of the invention will be set forth in part in the description which follows and, in part, will be apparent from the description, or may be learned by practice of the invention.

The foregoing and other aspects of the present invention are achieved by providing a refrigerator including: a freezing compartment; a freezing compartment door to open and close the freezing compartment; an icemaker positioned in the freezing compartment to produce ice cubes; an ice cube container to contain the ice cubes produced by the icemaker; first and second ice dispensing units positioned in the ice cube container; a shaved ice dispensing unit positioned in front of the first ice dispensing unit to make the ice cubes supplied from the first ice dispensing unit into shaved ice; and a control unit to control the first and second ice dispensing units to independently operate and to control the first ice dispensing unit and the shaved ice dispensing unit to operate in connection with each other when producing the shaved ice.

The shaved ice dispensing unit is positioned in the freezing compartment door.

The ice cube container includes a partition plate disposed longitudinally therein to separate the first and second ice dispensing units in the ice cube container.

The second ice dispensing unit includes an outlet adjusting device and a plurality of cutters to allow the ice cubes and crushed ice to be selectively dispensed through the second ice dispensing unit.

The shaved ice dispensing unit includes a case having a shaved ice outlet formed therethrough, at least one blade positioned at the shaved ice outlet, a rotational barrel rotatably positioned within the case to convey the ice cubes towards the blade, and a driving motor to rotate the rotational barrel.

The shaved ice dispensing unit further includes a reduction gear assembly coupled with the driving motor, and a torus gear formed around an outer peripheral surface of the rotational barrel while engaging with the reduction gear assembly to allow the rotational barrel to rotate at a constant velocity.

The rotational barrel includes a spiral wing provided on an inner peripheral surface of the rotational barrel to force the ice cubes to be conveyed to the blade and to be shaved into the shaved ice.

The freezing compartment door includes a recess part formed therein to accommodate the shaved ice dispensing unit, and the shaved ice dispensing unit further includes a housing coupled with the recess part to fix the case, the driving motor, and the reduction gear assembly therein.

The housing includes a first hollow protrusion formed at a center of the housing in an axial direction to penetrate the center of the case, and the rotational barrel includes a second hollow protrusion formed at a center of the rotational barrel and fitted onto the first hollow protrusion to allow the rotational barrel to stably rotate.

The recess part includes a vertical protrusion formed through the center of the recess part such that first hollow protrusion is fitted onto the vertical protrusion to securely fix the housing within the recess part.

The freezing compartment door includes a shaved ice discharge port communicated with the shaved ice dispensing unit, and an ice cube/crushed ice discharge port located below the second ice dispensing unit.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
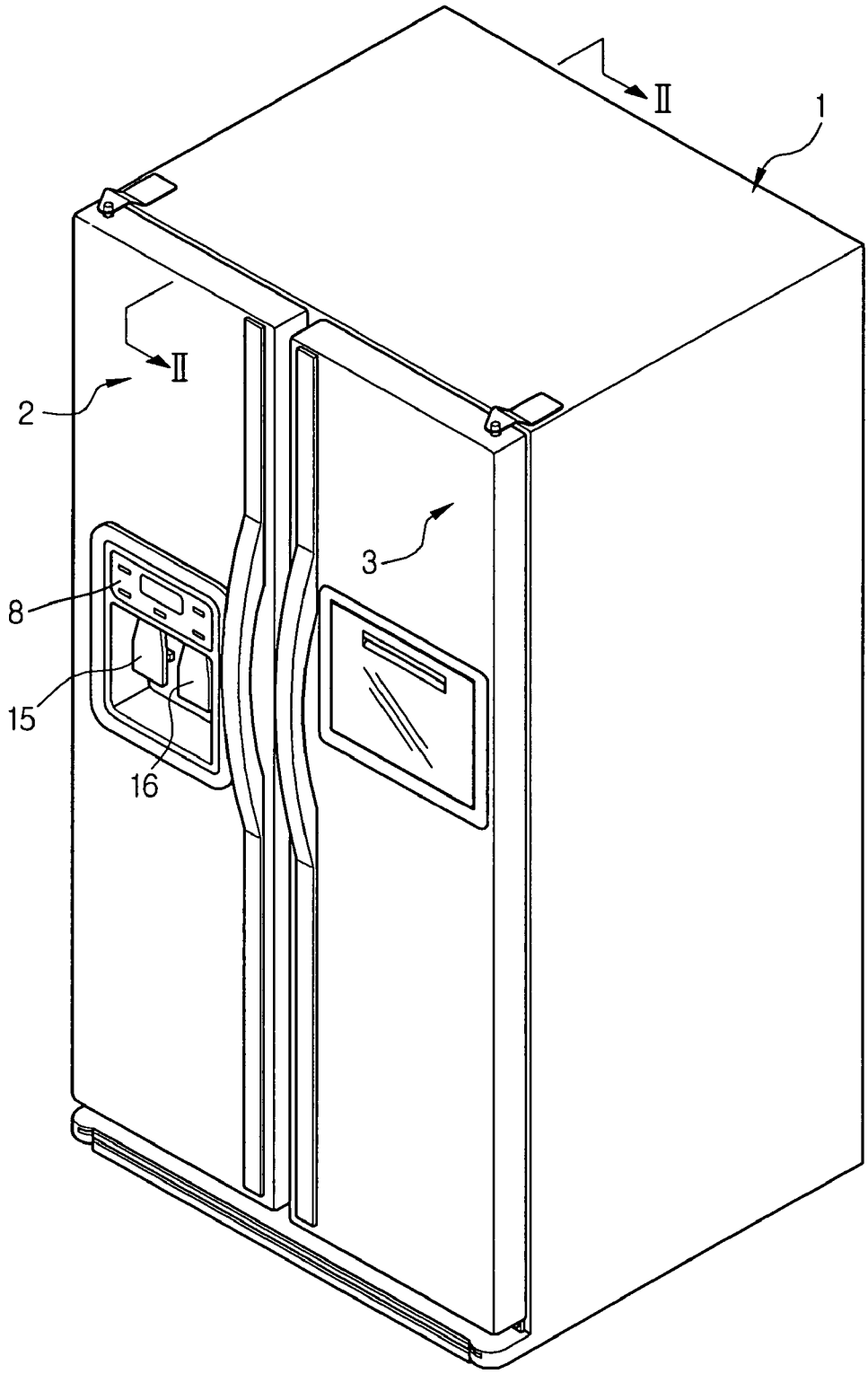
FIG. 1 is a perspective view illustrating an appearance of a refrigerator in accordance with an embodiment of the present invention.

Reference will now be made in detail to the embodiments of the present invention, examples of which are illustrated in the accompanying drawings, wherein like reference numerals refer to the like elements throughout the drawings. The embodiments are described below to explain the present invention by referring to the figures.

Figure 2:
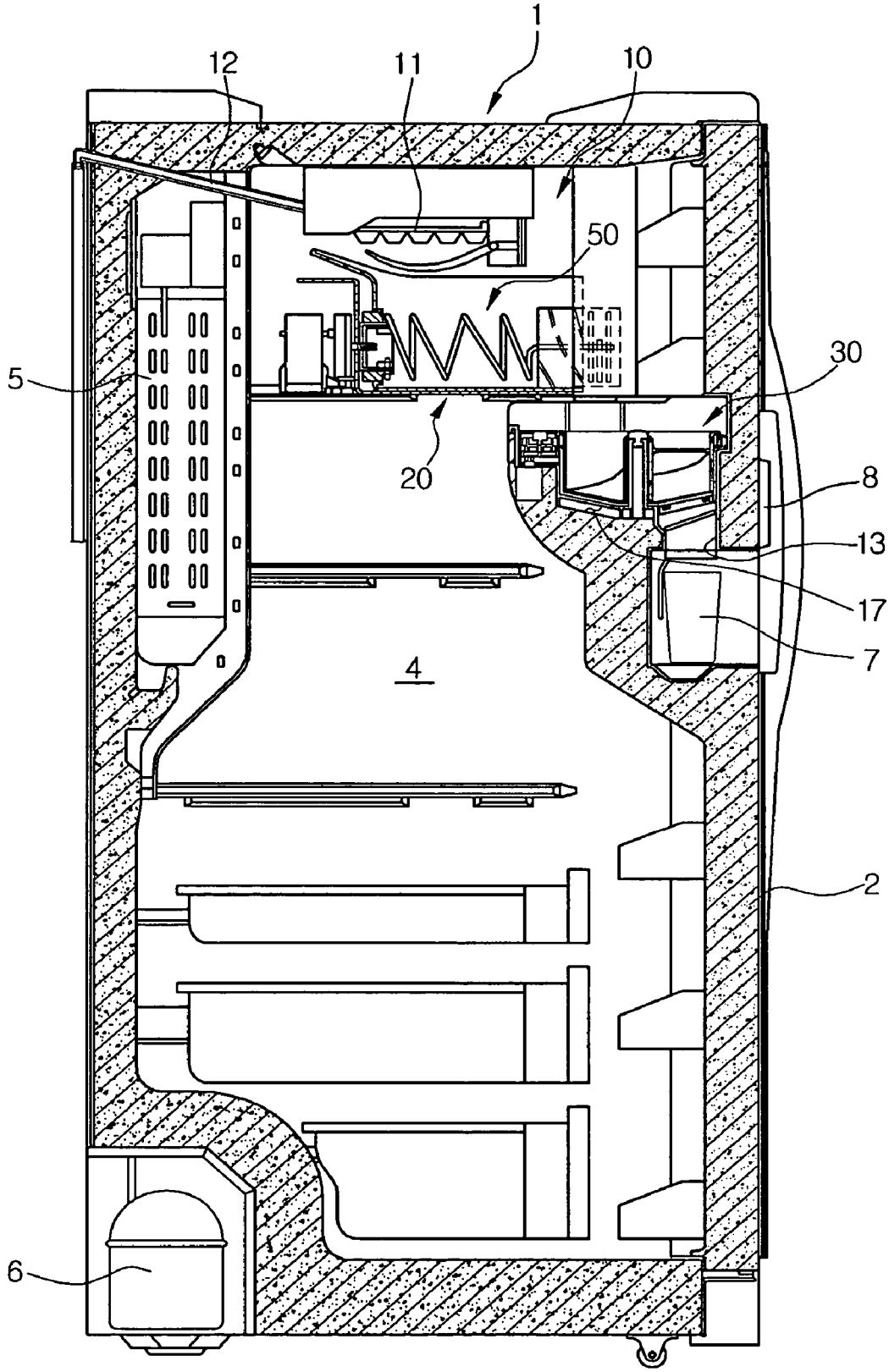
FIG. 2 is a cross-sectional view taken along line II-II of FIG. 1, illustrating a schematic inner construction of the refrigerator.

FIG. 1 is a perspective view illustrating an appearance of a refrigerator in accordance with an embodiment of the present invention, and FIG. 2 is a cross-sectional view taken along line II-II of FIG. 1, which illustrates a schematic inner construction of the refrigerator.

As shown in FIGS. 1 and 2, the refrigerator comprises a body 1 opened at a front side thereof and defining an appearance of the refrigerator. The body 1 comprises an inner space partitioned into a freezing compartment 4 and a refrigerating compartment (not shown), which are opened and closed by a freezing compartment door 2 and a refrigerating compartment door 3 hingably coupled with the front side of the body 1, respectively.

The refrigerator comprises an evaporator 5 on a rear wall of the body 1 to generate cold air, and a compressor 6 at a rear of a lower portion of the body 1 to compress refrigerant, and an automatic icemaker 10 at an upper portion of the freezing compartment 4 to automatically produce and supply ice cubes of a predetermined size.

The automatic icemaker 10 comprises an ice tray 11 to freeze water into the ice cubes after receiving the water, an ice cube container 20 disposed below the ice tray 11 to contain the ice cubes formed in the ice tray 11, and a water feeding pipe 12 connected with an external water reservoir and extending above the ice tray 11 to feed the water into the ice tray 11.

The freezing compartment door 2 comprises a shaved ice dispensing unit 30 to dispense shaved ice after making ice cubes, conveyed from the ice cube container 20, into the shaved ice, and the ice cube container 20 is provided with a first ice dispensing unit 50 to dispense the ice cubes to the shaved ice dispensing unit 30.

The ice cube container 20 comprises a second ice dispensing unit 60 disposed in parallel to the first ice dispensing unit 50 so that the ice cubes and crushed ice are selectively dispensed to a user. The freezing compartment door 2 comprises a recess part 17 to accommodate the shaved ice dispensing unit 30 therein, a shaved ice discharge port 13, and an ice cube/crushed ice discharge port 14 (see FIG. 3).

The freezing compartment door 2 further comprises a shaved ice discharge lever 15, and an ice cube/crushed ice discharge lever 16 below the shaved ice discharge port 13 and the ice cube/crushed ice discharge port 14, respectively. A control unit 8 is provided above the shaved ice discharge lever 15 and the ice cube/crushed ice discharge lever 16 on an outer surface of the freezing compartment 2. The control unit 8 comprises a shaved ice selection button, an ice cube selection button, and a crushed ice selection button.

The controller 8 controls the automatic icemaker 10 to automatically produce the ice cubes, and when one of the shaved ice selection button, the ice cube selection button, and the crushed ice selection button is pushed, the controller 8 controls one of the shaved ice dispensing unit 30 and the first and second ice dispensing units 50 and 60 to be selectively operated to dispense the shaved ice, the ice cubes or the crushed ice according to selection of a user.

Thus, after a predetermined time has elapsed since the ice tray 11 was filled with water through the water feeding pipe 12, the water within the ice tray 11 is frozen into ice cubes by virtue of cold air circulating in the freezing compartment 4. Then, the ice cubes are automatically conveyed to and fill up the ice cube container 20. These processes are controlled by the control unit 8.

In this state, when the shaved ice selection button of the control unit 8, and the shaved ice discharge lever 15 are pushed, the control unit 8 controls the first ice dispensing unit 50 and the shaved ice dispensing unit 30 to produce the shaved ice. The shaved ice is dispensed to the outside of the freezing compartment door 2 through the shaved ice discharge port 13, and fills up a cup 7.

In the same manner, when the ice cube selection button of the control unit 8, and the ice cube/crushed ice discharge lever 16 are pushed, the control unit 8 controls the second ice dispensing unit 60 to produce and dispense the ice cubes to the outside of the freezing compartment door 2 through the ice cube/crushed ice discharge port 14. As a matter of course, when the crushed ice selection button of the control unit 8, and the ice cube/crushed ice discharge lever 16 are pushed, the control unit 8 controls the second ice dispensing unit 60 to produce and dispense the crushed ice to the outside of the freezing compartment door 2 through the ice cube/crushed ice discharge port 14.

The construction and operation of the shaved ice dispensing unit 30, the first ice dispensing unit 50, and the second ice dispensing unit 60 will be described with reference to FIGS. 3 to 5.

Figure 3:
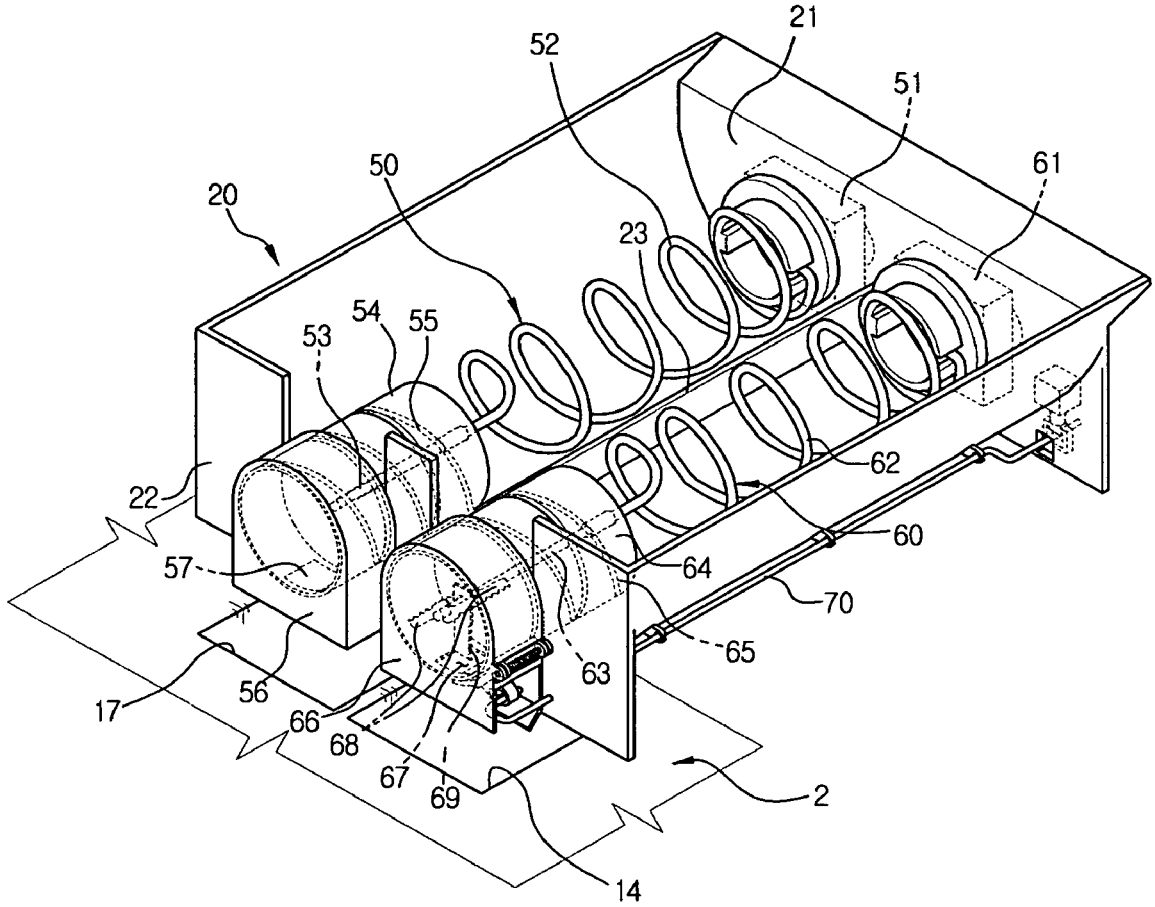
FIG. 3 is a perspective view illustrating an ice cube container shown in FIG. 2.

FIG. 3 illustrates the ice cube container shown in FIG. 2, and first and second ice dispensing units positioned within the ice cube container. FIG. 4 illustrates the construction of the shaved ice dispensing unit shown in FIG. 2, and FIG. 5 illustrates the shaved ice dispensing unit of FIG. 4 positioned in the freezing compartment door.

Referring to FIG. 3, the first and second ice dispensing units 50 and 60 are positioned in parallel within the ice cube container 20. The first and second ice dispensing units 50 and 60 are longitudinally equipped in parallel within the ice cube container 20 between a first end 21 of the ice cube container 20 located adjacent to a rear wall of the freezing compartment 4 and a second end 22 of the ice cube container 20 located adjacent to the freezing compartment door 2.

In order to allow the ice cubes contained within the ice cube container 20 to be smoothly conveyed to the first and second ice dispensing units 50 and 60, respectively, a partition plate 23 of a predetermined height is longitudinally disposed between the first and second ice dispensing units 50 and 60.

The first ice dispensing unit 50 comprises a driving motor 51 equipped on the first end 21 of the ice cube container 20, and a spiral guide 52 having one end coupled with the driving motor 51 and the other end extending towards the second end 22 of the ice cube container 20 while defining a space for guiding the ice cubes therein.

The first ice dispensing unit 50 further comprises a case 56 disposed outside of the second end 22 of the ice cube container 20 and having an ice cube outlet 57 formed therethrough, a rotational shaft 53 connected to the other end of the spiral guide 52 while extending towards the case 56, at least one spiral wing 55 coupled with the rotational shaft 53, and a guide barrel 54 surrounding an outer periphery of the spiral wing 55 to guide conveyance of the ice cubes.

Accordingly, as the spiral guide 52, the rotational shaft 53, and the spiral wing 55 coupled with the rotational shaft 53 are rotated by virtue of an operation of the driving motor 51, the ice cubes contained within the ice cube container 20 are forced to enter the guide barrel 54 by the spiral guide 52, conveyed through the guide barrel 54 by means of the spiral wing 55, and discharged through the ice cube outlet 57 of the case 56. Then, the ice cubes discharged from the ice cube outlet 57 are conveyed to the shaved ice dispensing unit 30 (shown in FIG. 2) positioned within the freezing compartment door 2.

The second ice dispensing unit 60 has a similar construction to that of the first ice dispensing unit 50 constructed as described above. That is, the second ice dispensing unit 60 comprises a driving motor 61 equipped parallel to the driving motor 51 of the first ice dispensing unit 50 on the first end 21 of the ice cube container 20, and a spiral guide 62 having one end coupled with the driving motor 61 and the other end extending towards the second end 22 of the ice cube container 20 while defining a space for guiding the ice cubes therein.

The second ice dispensing unit 60 further comprises a case 66 disposed outside of the second end 22 of the ice cube container 20 and having an ice cube/crushed ice outlet 67 formed therethrough, a rotational shaft 63 connected with the other end of the spiral guide 62 while extending towards the case 66, at least one spiral wing 65 coupled with the rotational shaft 63, and a guide barrel 64 surrounding an outer periphery of the spiral wing 65 to guide conveyance of the ice cubes.

The second ice dispensing unit 60 further comprises a pair of rotational cutters 68 coupled with the rotational shaft 63 at a location corresponding to the ice cube/crushed ice outlet 67, and a stationary cutter 69 fixed at the ice cube/crushed ice outlet 67 to be perpendicular to the rotational cutters 56, in order to crush the ice cubes, conveyed to the ice cube/crushed ice outlet 67 by the spiral wing 65, into the crushed ice.

The second ice dispensing unit 60 further comprises a discharge port adjusting device 70, which can adjust the size of the ice cube/crushed ice outlet 67 so as to allow non-crushed ice, that is, the ice cubes, to be discharged together with the crushed ice from the second ice dispensing unit 60.

Accordingly, after adjusting the size of the ice cube/crushed ice outlet 67 to prevent the ice cubes from escaping through the outlet 59 by use of the outlet adjusting device 60 through the control unit 8, the driving motor 61 is driven to rotate the spiral guide 62, the rotational shaft 63, and the spiral wing 65 coupled with the rotational shaft 63. Then, the ice cubes contained in the ice cube container 20 are pushed thereby into the guide barrel 64, in which the ice cubes are conveyed to the ice cube/crushed ice outlet 67 of the case 66 by the spiral wing 65. As a result, the ice cubes are crushed into the crushed ice of a size corresponding to the adjusted size of the ice cube/crushed ice outlet 67 through operation of the rotational cutters 68 and the stationary cutter 69. The crushed ice is dispensed to the outside of the freezing compartment door 2 through the ice cube/crushed ice discharge port 14 formed in the freezing compartment door 2.

On the contrary, when the driving motor 61 is driven with the size of the ice cube/crushed ice outlet 67 adjusted to allow the ice cubes to pass through the outlet 67 by use of the outlet adjusting device 60 through the control unit 8, the ice cubes are conveyed to the ice cube/crushed ice outlet 67 by the spiral wing 65, and pass through the outlet 67 without being crushed by the rotational cutters 68 and the stationary cutter 69. Then, the ice cubes are dispensed to the outside of the freezing compartment door 2 through the ice cube/crushed ice discharge port 14.

Figure 4:
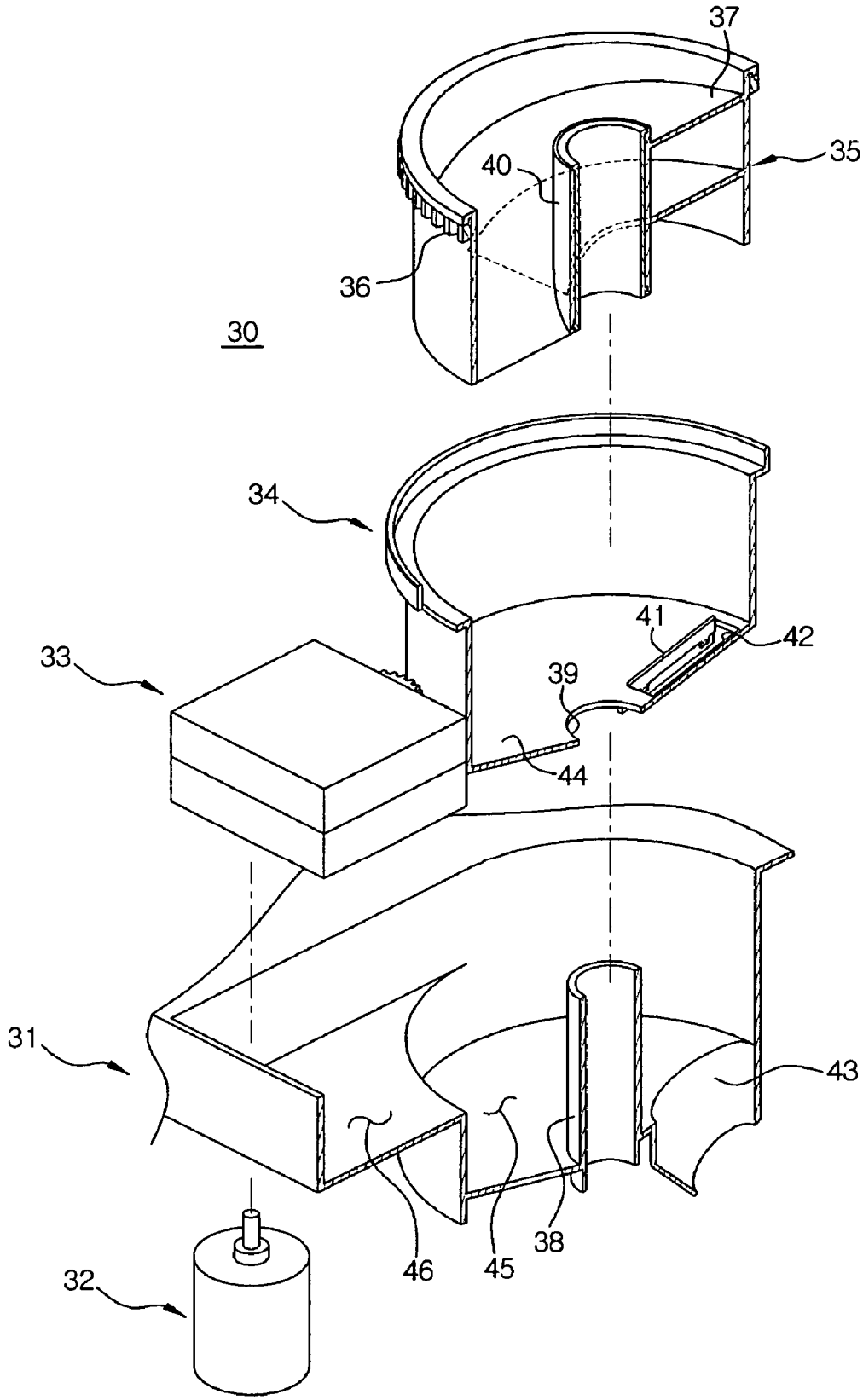
FIG. 4 is an exploded perspective view illustrating the construction of a shaved ice dispensing unit shown in FIG. 2.

As shown in FIG. 4, the shaved ice dispensing unit 30 according to an embodiment of the present invention comprises a housing 31, which is accommodated inside the freezing compartment door 2 while being fixed to the recess part 17 communicated with the shaved ice discharge port 13, and which comprises a first installation area 45 and a second installation area 46 defined therein, a driving motor 32 disposed outside of the housing 31 corresponding to the second installation area 46, a reduction gear assembly 33 positioned within the second installation area 46 above the driving motor 32, a case 34 securely fitted into the first installment area 45 of the housing 31, and a rotational barrel 35 rotatably disposed within the case 34.

The reduction gear assembly 33 comprises a plurality of reduction gears, which are engaged with one another, and is coupled with a shaft of the driving motor 32 to appropriately reduce a rotational velocity of the driving motor 32.

The rotational barrel 35 is opened at upper and lower portions thereof, and comprises a torus gear 36, which is formed around an outer peripheral surface of the upper portion of the rotational barrel 35 and engages with the reduction gear assembly 33, and at least one spiral wing 37 spirally extending on an inner peripheral surface of the rotational barrel 35.

The case 34 comprises the rotational barrel 35 rotatably fitted therein, and is of a shape opened at an upper portion thereof while being closed by a bottom plate 44. A shaved ice outlet 42 is formed through the bottom plate 44 of the case 34.

Additionally, a blade 41 is fixed to the bottom plate 44 of the case 34, and protruded above the shaved ice outlet 42. The shaved ice outlet 42 and the blade 41 are radially disposed on the bottom plate 44, and produce shaved ice in corporation with the spiral wing 37 formed on the inner peripheral surface of the rotational barrel 33.

The housing 31 has an opening 43 of a predetermined size formed through the bottom of the housing 31 at a location facing the shaved ice outlet 42, so as to allow the shaved ice formed through the shaved ice outlet 42 to be dispensed through the housing 31 to the shaved ice discharge port 13 formed in the freezing compartment door 2.

Although one blade 41 is radially equipped to the shaved ice outlet 42 as an example, a plurality of blades 41 may be uniformly equipped to the shaved ice outlet 42, so that a large amount of shaved ice can be rapidly produced.

Additionally, a first hollow protrusion 38 is upwardly provided at a center of the first installation space 45 of the housing 31 to penetrate a centering hole 39 formed at the center of the case 34, and a second hollow protrusion 40 is provided at a center of the rotational barrel 35 to couple to an outer peripheral surface of the first hollow protrusion 38 of the housing 31.

The second hollow protrusion 40 is slightly larger than the first hollow protrusion 38, such that the rotational barrel 35 can be freely rotated in a state that the second hollow protrusion 40 is fitted onto the first hollow protrusion 38.

Accordingly, with the first hollow protrusion 38 of the housing 31 penetrating the centering hole 39 of the case 34, the outer peripheral surface of the case 34 comes into intimate contact with the inner peripheral surface of the housing 31, and then the rotational barrel 35 is disposed within the case 34 by coupling the second hollow protrusion 40 of the rotational barrel 35 to the first hollow protrusion 38 of the housing 31, so that the case 34 is securely fixed to the housing 31, while allowing the rotational barrel 35 to be rotated within the case 34.

Here, the case 34 may be securely fixed to the housing 31 by means of other fastening manners, such as screw fastening. Alternatively, in the case of the construction having the driving motor 32 and the reduction gear assembly 33 installed in the case, the case 34 can act as the housing 31, so that the shaved ice dispensing unit 30 of the invention may be provided without the housing 31.

Figure 5:
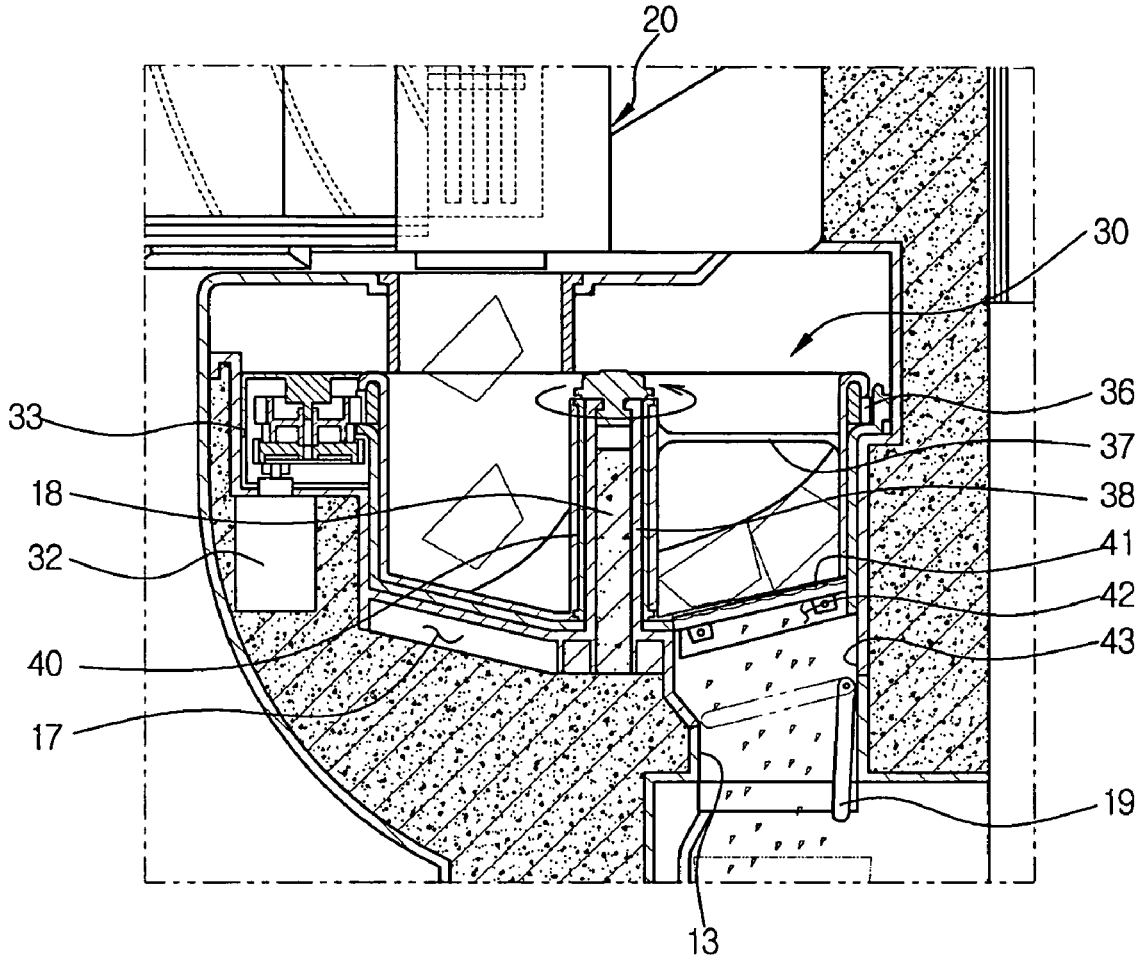
FIG. 5 is a cross-sectional view illustrating the shaved ice dispensing unit of FIG. 4 positioned in a freezing compartment door.

Referring to FIG. 5, the recess part 17 is of a shape corresponding to an appearance of the housing 31 having the driving motor 32 mounted therein, in order to engage the shaved ice dispensing unit 30 to the recess part 17 inside the freezing compartment door 2.

The recess part 17 comprises a vertical protrusion 18 formed at the center of the recess part 17 to allow the first hollow protrusion 38 of the housing 31 to be fitted onto and then fixed to the vertical protrusion 18. Accordingly, as the first hollow protrusion 38 is fitted onto the vertical protrusion 18, and the outer peripheral surface of the housing 31 is coupled with the inside of the recess portion 17, the shaved ice dispensing unit 30 is fixed to the recess part 17 of the freezing compartment door 2.

Here, the housing 31 may be coupled with an inner surface of the freezing compartment door 2 by means of screws or other fastening means, in a state of being inserted into the recess part 17.

As such, the recess part 17 having the shaved ice dispensing unit 30 equipped therein is communicated with the shaved ice discharge port 13, so that the shaved ice produced by the shaved ice dispensing unit 30 is guided to the outside of the freezing compartment door 2 through the recess part 17. A cover 19 is hingably equipped to the opening 43 of the housing 31, and operated to close the opening 43 by the shaved ice discharge lever 15.

Accordingly, upon operation of the shaved ice discharge lever 15 provided on the outer surface of the freezing compartment door 2, the cover 19 equipped to the opening 43 of the housing 31 is pivoted, allowing the shaved ice dispensing unit 30 to communicate with the shaved ice discharge port 13, and the ice cubes are conveyed into the rotational barrel 35 of the shaved ice dispensing unit 30 positioned within the freezing compartment door 2 by the first ice dispensing unit 50 positioned together with the second ice dispensing unit 60 within the ice cube container 20 of the freezing compartment 4.

In this state, upon rotation of the driving motor 32 of the shaved ice dispensing unit 30, the reduction gear assembly 33 transmits a rotational force of the driving motor 32 to the rotational barrel 35, and rotates the rotational barrel 35 at an appropriate velocity.

Upon rotation of the rotational barrel 35, the spiral wing 37 positioned within the rotational barrel 35 compresses the ice cubes against the bottom of the case 34, and the ice cubes are thus shaved into shaved ice by means of the blade 41 disposed at the shaved ice outlet 42 on the bottom plate 44 of the case 34. Then, the shaved ice is dispensed through the shaved ice outlet 42 and the opening 43 of the housing 31.

The shaved ice produced by the shaved ice dispensing unit 30 as described above continues to be discharged to the outside of the freezing compartment door 2 through the shaved ice discharge port 13, and is dispensed into the cup 7 located at the shaved ice discharge lever 15 side, thereby allowing convenient shaved ice dispensing.

As is apparent from the above description, the refrigerator according to the present invention has the plural ice dispensing units positioned in the ice cube container provided to the freezing compartment, and the shaved ice dispensing unit positioned within the freezing compartment door, thereby allowing convenient dispensing of the shaved ice and the crushed ice to the outside of the freezing compartment door, so that the user of the refrigerator is provided with various shapes of ice.

Although a few embodiments of the present invention have been shown and described, it would be appreciated by those skilled in the art that various modifications, additions and substitutions may be made in these embodiments without departing from the principle and spirit of the invention, the scope of which defined in the claims and their equivalents.

What is claimed is:

1. A refrigerator comprising:

a freezing compartment;

a freezing compartment door to open and close the freezing compartment;

an icemaker positioned in the freezing compartment to produce ice cubes;

an ice cube container to contain the ice cubes produced by the icemaker;

first and second ice dispensing units positioned in the ice cube container;

a shaved ice dispensing unit positioned in front of the first ice dispensing unit to make the ice cubes supplied from the first ice dispensing unit into shaved ice; and a control unit to control the first and second ice dispensing units to independently operate and to control the first ice dispensing unit and the shaved ice dispensing unit to operate in connection with each other when producing the shaved ice, wherein the second ice dispensing unit comprises an outlet adjusting device and a plurality of cutters to allow the ice cubes and crushed ice to be selectively dispensed through the second ice dispensing unit.

2. The refrigerator according to claim 1, wherein the shaved ice dispensing unit is positioned in the freezing compartment door.

3. The refrigerator according to claim 1, wherein the ice cube container comprises a partition plate disposed longitudinally therein to separate the first and second ice dispensing units in the ice cube container.

4. The refrigerator according to claim 3, wherein the freezing compartment door comprises a shaved ice discharge port communicated with the shaved ice dispensing unit, and an ice cube/crushed ice discharge port located below the second ice dispensing unit.

5. A refrigerator comprising:

a freezing compartment:

a freezing compartment door to open and close the freezing compartment;

an icemaker positioned in the freezing compartment to produce ice cubes;

an ice cube container to contain the ice cubes produced by the icemaker;

first and second ice dispensing units positioned in the ice cube container;

a shaved ice dispensing unit positioned in front of the first ice dispensing unit to make the ice cubes supplied from the first ice dispensing unit into shaved ice; and a control unit to control the first and second ice dispensing units to independently operate and to control the first ice dispensing unit and the shaved ice dispensing unit to operate in connection with each other when producing the shaved ice, wherein the shaved ice dispensing unit comprises a case having a shaved ice outlet formed there through, at least one blade positioned at the shaved ice outlet, a rotational barrel rotatably positioned within the case to convey the ice cubes towards the blade, and a driving motor to rotate the rotational barrel.

6. The refrigerator according to claim 5, wherein the shaved ice dispensing unit further comprises a reduction gear assembly coupled with the driving motor, and a torus gear formed around an outer peripheral surface of the rotational barrel while engaging with the reduction fear assembly to allow the rotational barrel to rotate at a constant velocity.

7. The refrigerator according to claim 5, wherein the rotational barrel comprises a spiral wing provided on an inner peripheral surface of the rotational barrel to force the ice cubes to be conveyed to the blade and shaved into the shaved ice.

8. The refrigerator according to claim 5, wherein the freezing compartment door comprises a recess part formed therein to accommodate the shaved ice dispensing unit, and the shaved ice dispensing unit further comprises a housing coupled with the recess part to fix the case, the driving motor, and the reduction gear assembly therein.

9. The refrigerator according to claim 8, wherein the housing comprises a first hollow protrusion formed at a center of the housing in an axial direction to penetrate the center of the case, and the rotational barrel comprises a second hollow protrusion formed at a center of the rotational barrel and fitted onto the first hollow protrusion to allow the rotational barrel to stably rotate.

10. The refrigerator according to claim 9, wherein the recess part comprises a vertical protrusion formed through the center of the recess part such that first hollow protrusion is fitted onto the vertical protrusion to securely fix the housing within the recess part.

11. A refrigerator comprising:

a freezing compartment;

a freezing compartment door to open and close the freezing compartment;

first and second ice dispensing units positioned in parallel in the ice cube container;

a shaved ice dispensing unit positioned in front of the first ice dispensing unit to make the ice cubes supplied from the first ice dispensing unit into shaved ice;

a shaved ice discharge port formed through the freezing compartment door below the shaved ice dispensing unit to discharge the shaved ice produced through the shaved ice dispensing unit; and an ice cube/crushed ice discharge port formed through the freezing compartment door below the second ice dispensing unit to discharge the ice cube or crushed ice produced through the second ice dispensing unit.

12. The refrigerator according to claim 11, wherein the ice cube container comprises a partition plate between the ice cube conveyer and the crushed ice dispensing unit to allow the ice cubes to be smoothly supplied into the ice cube conveyer and the crushed ice dispensing unit, respectively.

13. The refrigerator according to claim 11, wherein the shaved ice dispensing unit comprises a case having a shaved ice outlet formed therethrough, at least one blade equipped at the shaved ice outlet, a rotational barrel rotatably equipped within the case to convey the ice cubes towards the blade, and a driving motor to rotate the rotational barrel.

14. The refrigerator according to claim 13, wherein the shaved ice dispensing unit further comprises a reduction gear assembly coupled with the driving motor, and a torus gear formed around an outer peripheral surface of the rotational barrel while being engaged with the reduction gear assembly to allow the rotational barrel to rotate in a constant velocity.

15. The refrigerator according to claim 11, wherein the second ice dispensing unit comprises an outlet adjusting device and a plurality of cutters to allow the ice cubes and crushed ice to be selectively dispensed through the second ice dispensing unit.

* * * * *

UNITED STATES PATENT AND TRADEMARK OFFICE

CERTIFICATE OF CORRECTION

PATENT NO. : 7,360,377 B2
APPLICATION NO. : 11/221973
DATED : April 22, 2008
INVENTOR(S) : Yong Pil Park et al.

It is certified that error appears in the above-identified patent and that said Letters Patent is hereby corrected as shown below:

Column 8, Line 24, change “refrigerator” to --refrigerator,--.

Column 8, Line 59, change “compartment:” to --compartment;--.

Column 9, Line 10, change “there through” to --therethrough--.

Column 9, Line 19, change “fear” to --gear--.

Column 10, Line 1, change “refrigerator” to --refrigerator,--.

Signed and Sealed this

Twenty-sixth Day of August, 2008

JON W. DUDAS
*Director of the United States Patent and Trademark Office*